US007597326B2

(12) United States Patent
D'Antonio

(10) Patent No.: US 7,597,326 B2
(45) Date of Patent: Oct. 6, 2009

(54) BOARD GAME USING THE ALPHABET AND COLORS

(76) Inventor: Dennis P. D'Antonio, 612 W. Lincoln Ave., Royal Oak, MI (US) 48067

( * ) Notice: Subject to any disclaimer, the term of this patent is extended or adjusted under 35 U.S.C. 154(b) by 176 days.

(21) Appl. No.: 11/404,027

(22) Filed: Apr. 13, 2006

(65) Prior Publication Data

US 2007/0241500 A1 Oct. 18, 2007

(51) Int. Cl.
*A63F 3/00* (2006.01)

(52) U.S. Cl. ..... 273/243; 273/236

(58) Field of Classification Search ..... 273/243, 273/262, 226

See application file for complete search history.

(56) References Cited

U.S. PATENT DOCUMENTS

| | | | | | |
|---|---|---|---|---|---|
| 1,556,678 | A | | 10/1925 | Diegel | |
| 2,322,564 | A | | 6/1943 | Buckley et al. | |
| 2,454,479 | A | | 11/1948 | Rosenberger | |
| 2,672,344 | A | | 3/1954 | Wakefield | |
| 3,214,848 | A | | 11/1965 | Van Eycke | |
| 3,582,080 | A | | 6/1971 | Schick | |
| 3,850,433 | A | | 11/1974 | Purlia | |
| 3,926,438 | A | | 12/1975 | Breslow et al. | |
| 4,055,347 | A | * | 10/1977 | Kreischer | 273/243 |
| 4,557,485 | A | * | 12/1985 | Lardon | 273/249 |
| 4,682,777 | A | * | 7/1987 | Wood | 273/243 |
| 4,690,409 | A | | 9/1987 | Scalia | |
| 4,706,960 | A | * | 11/1987 | Nowacki et al. | 273/257 |
| 4,878,675 | A | | 11/1989 | Perry et al. | |
| 4,932,668 | A | | 6/1990 | Stewart | |
| 4,936,588 | A | | 6/1990 | Rader et al. | |
| 5,217,225 | A | | 6/1993 | Dubarry, Jr. | |
| 5,299,808 | A | | 4/1994 | Wood | |
| 5,316,482 | A | | 5/1994 | Bryson | |
| 5,340,105 | A | | 8/1994 | Gostyla | |
| 5,342,058 | A | | 8/1994 | Giovannetti | |
| 5,362,061 | A | | 11/1994 | Napolitano | |
| 5,645,280 | A | | 7/1997 | Zelmer | |
| 5,829,746 | A | | 11/1998 | Pacella | |
| 6,045,128 | A | | 4/2000 | Hunt | |
| 6,182,965 | B1 | | 2/2001 | Escott et al. | |
| 6,186,505 | B1 | * | 2/2001 | Perrie et al. | 273/274 |
| 6,230,131 | B1 | | 5/2001 | Kuhn et al. | |
| 6,286,833 | B1 | | 9/2001 | Collins | |
| 6,406,300 | B1 | | 6/2002 | Cohen | |
| 6,527,272 | B1 | | 3/2003 | Conner | |
| 6,648,648 | B1 | | 11/2003 | O'Connell | |
| 6,659,774 | B1 | | 12/2003 | Ramos et al. | |
| 6,669,196 | B1 | | 12/2003 | Washko | |
| 6,685,187 | B1 | | 2/2004 | Kline et al. | |
| 2002/0101032 | A1 | | 8/2002 | Buerk | |
| 2004/0012148 | A1 | | 1/2004 | Wittig | |
| 2004/0041345 | A1 | | 3/2004 | Novak | |
| 2007/0063435 | A1 | * | 3/2007 | Tippy | 273/243 |

* cited by examiner

*Primary Examiner*—Vishu K. Mendiratta
(74) *Attorney, Agent, or Firm*—Harness, Dickey & Pierce, P.L.C.

(57) ABSTRACT

A board game includes a game board having spaces about a perimeter. The spaces include a first group each displaying one alphabet letter. The first group is divided into subgroups, each having a subgroup color different from any other subgroup. A second group includes identical rest area spaces. A third group is lucky day spaces positioned between consecutive rest area spaces. Multiple color cards displaying one of the alphabet letters are positioned near the first group of spaces having a same one of the alphabet letters. One object is to remove all of an opponent's color cards. Another object is to color card all of a player's own home base spaces.

27 Claims, 8 Drawing Sheets

138

YOU MAY

ADD (2) TWO

HOME BASE COLOR CARDS

(If at least one COLOR CARD is added you T.A.T.)

140

YOU MAY

ADD (3) THREE

HOME BASE COLOR CARDS

(If any COLOR CARD(S) are added you T.A.T.)

142

*EACH* OPPONENT WILL

REMOVE (1) ONE

HOME BASE COLOR CARD

IF HOME BASE HAS NO COLOR CARD TO REMOVE, OPPONENT TO PAY YOU THE *CASH EQUIVALENT*~ TWO (2) DOLLARS

(If COLOR CARD is removed you T.A.T.)

144

*EACH* OPPONENT WILL

REMOVE (2) TWO

HOME BASE COLOR CARDS

IF SHORT HOME BASE COLOR CARD(S) TO REMOVE, OPPONENT TO PAY YOU THE DIFFERENCE IN CASH EQUIVALENT.

(If any COLOR CARD(S) are removed you T.A.T.)

150

YOU WILL GO TO ANY

LAVENDER LETTER

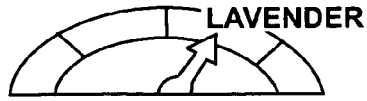

(If COLOR CARD is added you T.A.T.)

148

LUCKY DAY AGAIN

WILD CARD

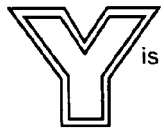

is for Yee-Ha!

DISCARD THIS Y CARD TO CANCEL PENALTY WHEN LANDING ON OPPONENTS HOME BASE, THEN DRAW A 'LUCKY DAY' CARD.

(Save Y card until used or sold for any agreed upon price)

146

CANCEL ACTION

WILD CARD

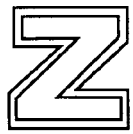

is for Zo as in...

"...I don ting Zo!"

DISCARD THIS Z CARD TO CANCEL OPPONENTS 'LUCKY DAY' CARD. OPPONENTS PLAY STOPS. TURN ENDS. OPPONENT WILL DISCARD CANCELED 'LUCKY DAY' CARD.

(Save Z card until used or sold for any agreed upon price)

Fig. 10

152

*EACH* OPPONENT WILL EITHER

REMOVE (4) FOUR

HOME BASE COLOR CARDS

OR PAY YOU CASH EQUIVALENT,
OR *ANY COMBINATION* THERE-OF

(If any COLOR CARD(S) are removed you T.A.T.)

166

YOU WILL GO TO ANY

YELLOW GREEN

LETTER

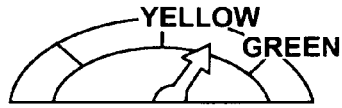

(If COLOR CARD is added you T.A.T.)

154

YOU WILL GO TO ANY

ORANGE LETTER

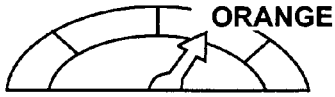

(If COLOR CARD is added you T.A.T.)

164

YOU WILL GO TO ANY

GREEN LETTER

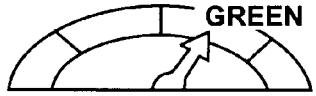

(If COLOR CARD is added you T.A.T.)

156

YOU WILL GO TO ANY

RED LETTER

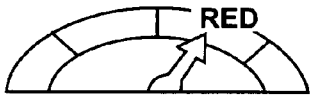

(If COLOR CARD is added you T.A.T.)

162

YOU WILL GO TO ANY

BLUE LETTER

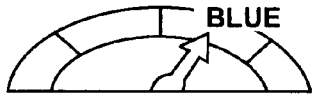

(If COLOR CARD is added you T.A.T.)

158

YOU WILL GO TO ANY

YELLOW LETTER

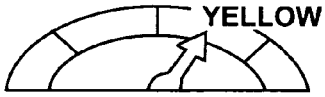

(If COLOR CARD is added you T.A.T.)

160

YOU WILL GO TO ANY

PURPLE LETTER

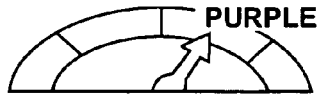

(If COLOR CARD is added you T.A.T.)

Fig. 11

BOARD GAME USING THE ALPHABET AND COLORS

TECHNICAL FIELD

The present disclosure relates in general to board games and more specifically to a board game having both educational and entertainment functions and different levels of play.

BACKGROUND

Games, including board games are known whose purpose is to both teach and entertain the players. Board games addressed to vocabulary improvement are known, such as disclosed in U.S. Pat. No. 5,316,482 to Bryson. Bryson and similar board games disclose a game board providing the various letters of the alphabet, and a plurality of playing cards. Colors have also been used in known board games to further teach or associate a color with a color name. Several disadvantages of known educational board games include the limitation of the game to a specific age group or learning group, a playing format limited to a single type of play, and game pieces or hardware that lack the ability to be used in more than one game format.

SUMMARY

According to several embodiments of the present disclosure, a board game includes a game board having a continuous path around a perimeter divided into consecutive spaces. The consecutive spaces include a first group of the spaces each displaying one letter of the alphabet consecutively ranging from A through X, the first group being further divisible into a plurality of subgroups, each subgroup having a subgroup color different from any other subgroup. A second group of the spaces define identical rest area spaces each positioned at one of four corners of the game board. A third group of the spaces each define a lucky day space, each one of the lucky day spaces being positioned between consecutive ones of the rest area spaces. Multiple color cards, each displaying one of the alphabet letters and each being of a size to be releasably positioned proximate a corresponding one of the first group of spaces have a same one of the alphabet letters.

According to additional embodiments, a spinning wheel assembly is provided to randomly identify a color or letter for a player's next move. The spinning wheel assembly includes an indicator member which is stationary with respect to a spinning disc having a multiple color ring disposed thereon. A base can also be provided which is also stationary with respect to the spinning wheel.

According to still other embodiments, a plurality of lucky day cards are provided. Each lucky day card identifies an action for the player who draws the card or an action the drawing player can impose on an opponent. A lucky day card is drawn when a player lands on one of a plurality of lucky day spaces positioned about the game board.

According to yet still other embodiments, each of the color cards displays a color which corresponds to a color bar defining three consecutive letters of the spaces and one of the subgroup colors. The color cards are therefore both color matched and alphabet letter matched to individual ones of the spaces.

A board game of the present disclosure offers several advantages. The game board includes individual spaces each having an alphabet letter displayed thereon. A color card is provided for each colored space also having an alphabet letter. Matching the color cards to the appropriate spaces therefore teaches players to recognize the individual alphabet letters. The use of play money and lucky day instruction cards also introduces more sophisticated levels of play for between two, three, or four players. The introduction of a decimator status also introduces a heightened element of competition. Further options such as selection of a last chance provide a player previously eliminated the opportunity to be reinstated to the game.

Further areas of applicability of the present disclosure will become apparent from the detailed description provided hereinafter. It should be understood that the description and specific examples, while indicating several embodiments, are intended for purposes of illustration only and are not intended to limit the scope of the disclosure.

BRIEF DESCRIPTION OF THE DRAWINGS

The present disclosure will become more fully understood from the description and the accompanying drawings, wherein:

FIG. 10 is a plan view of a second portion of exemplary lucky day cards;

FIG. 11 is a plan view of a third portion of exemplary lucky day cards; and

DETAILED DESCRIPTION

Figure 1:
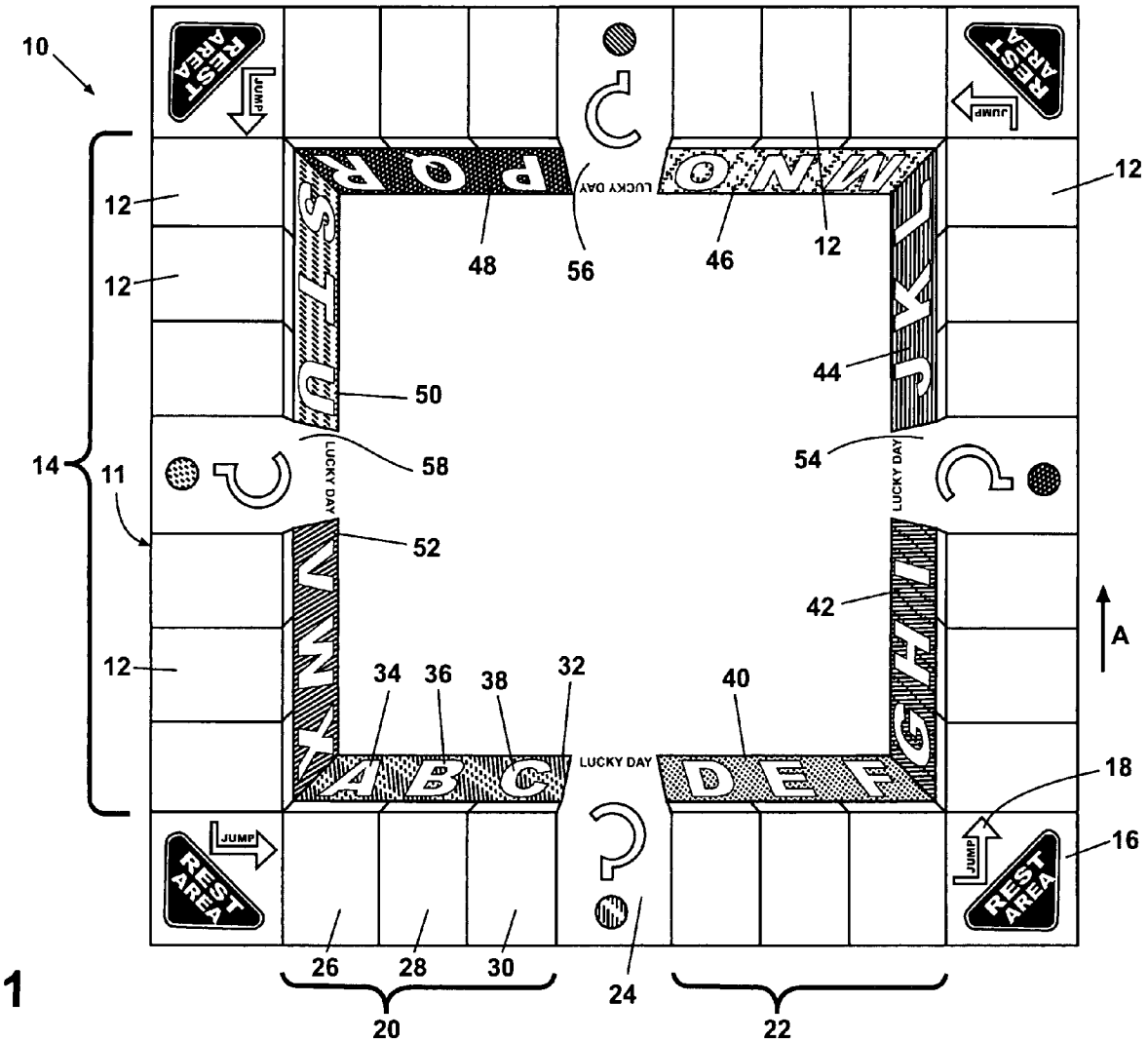
FIG. 1 is a plan view of the game board for an educational board game for learning alphabet and colors.

The following description of several embodiments is merely exemplary in nature and is in no way intended to limit the disclosure, their application, or uses. It should be understood that throughout the drawings, corresponding reference numerals indicate like or corresponding parts and features.

According to several embodiments and referring generally to FIG. 1, a game board 10 configured in a substantially rectangular shape includes each of four sides or edges 11 and a plurality of spaces 12 positioned about a perimeter of game board 10 proximate to the edges 11. A portion of the spaces 12 positioned along one of the edges 11 defines an individual player's home base 14. Up to four players can therefore use game board 10 by each selecting one of the edges 11 as their home base. In other embodiments, a game board having three, or more than four edges can also be used, allowing for three or more than four players. Each of four corners of game board 10 provides a rest area space 16. A jump arrow 18 is also displayed in each of the rest area spaces 16. The jump arrow(s) 18 are each oriented to indicate a direction of play which in some embodiments is in a counter-clockwise direction "A" about game board 10. The present disclosure is not limited to a direction of play and a clockwise direction is therefore also within the scope of the present disclosure.

Along each of the edges 11, a first subgroup 20 and a second subgroup 22 of spaces are defined. In the example shown, a first space 26, a second space 28 and a third space 30 define a first subgroup 20. Second space 28 is directly abutted on either side by first and third spaces 26 and 30 and each of the first space 26, second space 28, and third space 30 share a common first color bar 32. Color bar 32 also includes a first alphabet letter 34, a second alphabet letter 36 and a third alphabet letter 38. First alphabet letter 34 corresponds to first space 26, second alphabet letter 36 corresponds to second space 28 and third alphabet letter 38 corresponds to third space 30. A second subgroup 22 is similarly created by spaces having the letters D, E and F. Each of the remaining spaces about game board 10 are also configured into a plurality of subgroups similar to first and second subgroups 20, 22. A first lucky day space 24 is positioned between each of first subgroup 20 and second subgroup 22. Each of the other subgroups of spaces include their own color bar, for example second subgroup 22 includes a second color bar 40 differing in color from color bar 32 and the remaining color bars. Third through eighth color bars 42 through 52 are distributed about game board 10 as shown representing the remaining subgroups of spaces. Similar to first color bar 32 each of second through eighth color bars 40 through 52 include three alphabet letters in ascending order. Alphabet letters A through X are therefore sequentially displayed in a counterclockwise direction in the color bars 32 and 40 through 52.

A second, third and fourth lucky day space 54, 56, 58 are also positioned similar to first lucky day space 24 between abutting subgroups on the remaining edges 11 of game board 10. Each of the first through eighth color bars 32 and 40 through 52 are provided with a color differing from the other color bars.

Figure 2:
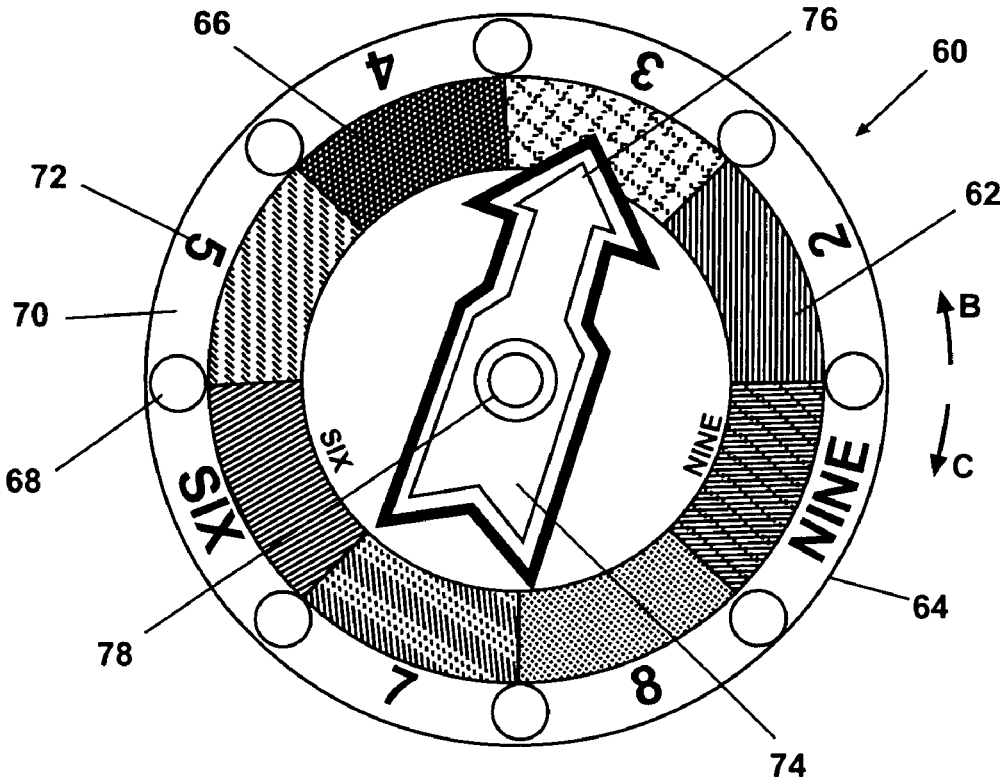
FIG. 2 is a plan view of a color spinner wheel assembly.

As best seen in reference to FIG. 2, a random indicator device 60 of the present disclosure includes an inner color section 62 disposed on a movable indicator element 64 inward of an outer perimeter of movable indicator element 64. Movable indicator element 64 is divisible into a plurality of color segments 66. Each of the colors of color segments 66 correspond to one of the colors defined by each of the color bars 32 or 40 through 52 of game board 10. Each color segment 66 is also visually distinguishable by a plurality of segment dividers 68 which in this example are circles, but can be any geometric shape. A plurality of outer ring segments 70 are outwardly positioned from inner color section 62, and divisible also by each of the segment dividers 68. A group of sequenced numbers 72 is individually displayed in separate outer ring segments 70. In the example shown, numbers 72 range from two through nine. To avoid confusion in determining the difference between the numerals six and nine, the numbers six and nine are spelled out in these positions. An indicator element 74 having an arrowhead 76 positioned at one distal end thereof is used during play to identify one of either the plurality of color segments 66 or one of the plurality of numbers 72. Movable indicator element 64 is rotatable in either a first rotational direction "B" or a second rotational direction "C".

Figure 3:
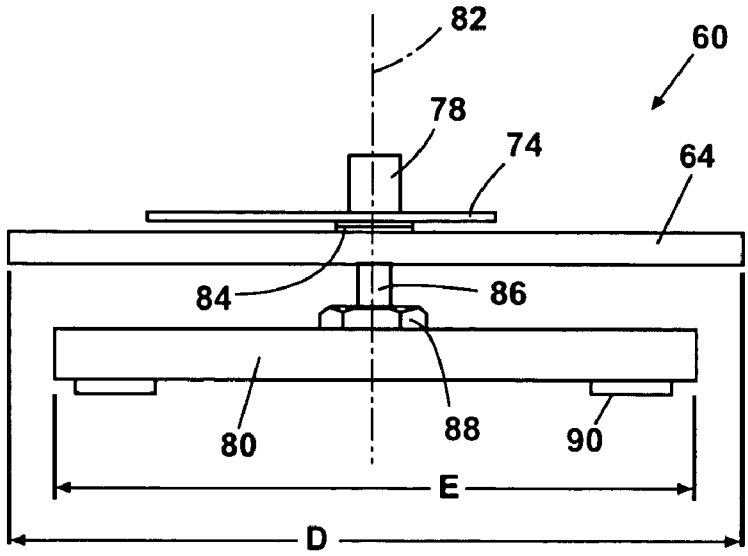
FIG. 3 is a side elevational view of the spinner assembly of FIG. 2.

Referring now generally to FIG. 3, further details of random indicator device 60 include a retention element 78, a support member 80 having movable indicator element 64 rotatably disposed thereon. Movable indicator element 64 is rotatable relative to support member 80 about a rotational axis 82. Indicator element 74 is spatially separated from movable indicator element 64 by a washer or spacer element 84. A support tube 86 is positioned between movable indicator element 64 and support member 80. Support tube 86 can be rotatably connected to support member 80 using a fastening element 88 and a fastener (not shown) extending upwardly through support member 80 and fastening element 88 such that support tube 86 is co-rotatable with indicator element 64. A portion of support tube 86 extends through retention element 78 such that element 78, indicator element 74, spacer 84 and support tube 86 are each non-rotatably disposed with respect to support member 80. Only movable indicator element 64 is rotatable with respect to support member 80. In use therefore a player rotates movable indicator element 64 by hand and indicator element 74 remains fixed in position having arrowhead 76 pointing toward one of color segments 66 when movable indicator element 64 stops spinning. Movable indicator element 64 and support member 80 can be any substantially rigid material, including a polymeric, a wood, a fiber or a metal material. One of skill in the art will recognize that random indicator device 60 can also be an electronically generated image, which will not require physically connected elements including retention element 78, support member 80, spacer element 84, support tube 86, or fastening element 88.

In the embodiment shown, each of movable indicator element 64 and support member 80 are substantially circular in shape, however, one of skill in the art will recognize this geometry can be changed to other geometric shapes. At least one friction pad 90 can also be attached a support surface side of support member 80. Friction pad 90 can be a resilient material such as a rubber or soft polymeric compound to provide non-rotational gripping support between support member 80 and a support surface that random indicator device 60 is positioned on. Random indicator device 60 can be supported on any flat surface including game board 10 or a table or floor surface. In the circular configuration, movable indicator element 64 includes a width dimension "D" and support member 80 includes a width dimension "E". In several embodiments, width dimension "E" is smaller than width dimension "D" so that contact with an outer perimeter area of movable indicator element 64 is easier for the player.

Figure 4:
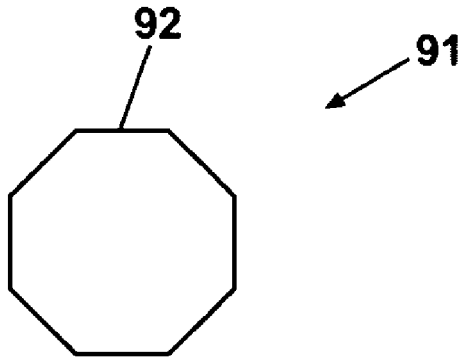
FIG. 4 is a top plan view of a player game piece.
Figure 5:
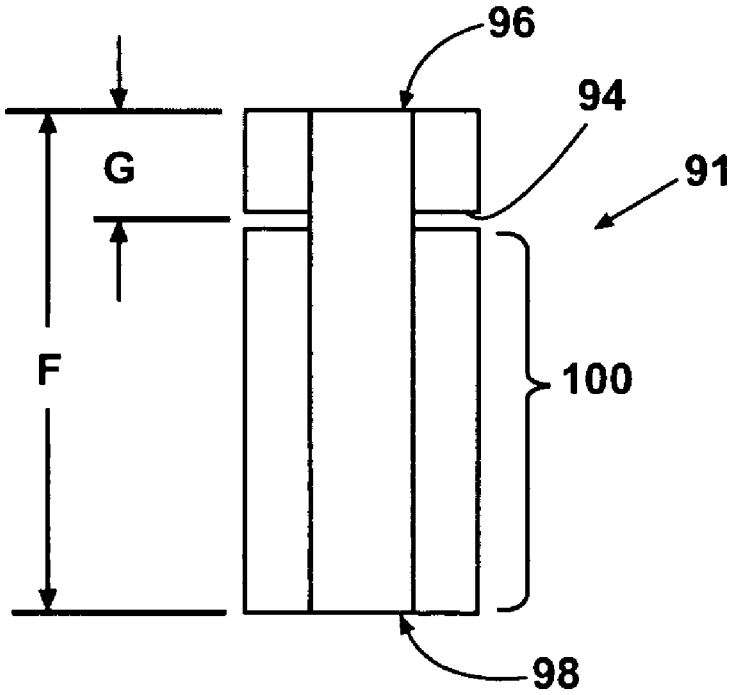
FIG. 5 is a side elevational view of the player game piece of FIG. 4.

Referring generally now to FIGS. 4 and 5, one of four game pieces 91 is shown. Each game piece 91 includes a perimeter wall 92 which in several embodiments is a geometric shape such as an octagon. Other geometric shapes such as circles, triangles, and other polygonal shapes can also be used for perimeter wall 92. Game pieces 91 can be created of a substantially rigid material similar to movable indicator element 64. A slot 94 can be provided in one or more of the segments of perimeter wall 92. Game piece 91 includes a game piece height "F". Slot 94 is positioned at a slot location "G" measurable from a first end 96 of game piece 91. Between slot 94 and a second end 98 of game piece 91 a color section 100 is defined. Color section 100 is painted or otherwise displays one of the colors of the various color bars of game board 10. Second end 98 can also include the color of color section 100. Game pieces 91 can also be provided of a material such as a polymeric material having the appropriate color throughout.

Figure 6:
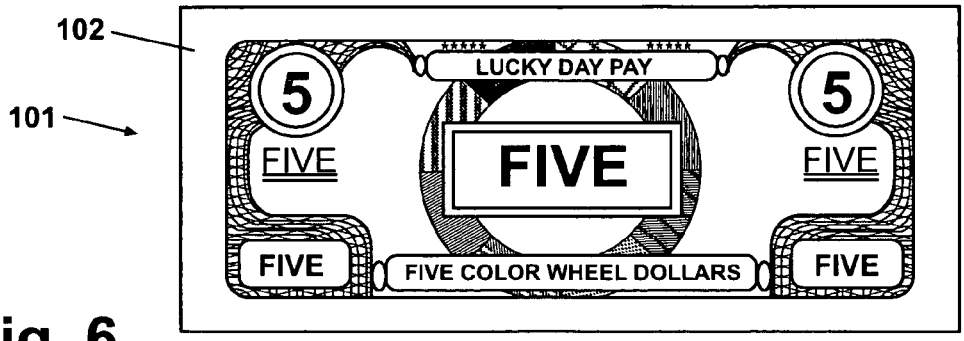
FIG. 6 is a plan view of an exemplary five dollar monetary card.
Figure 7:
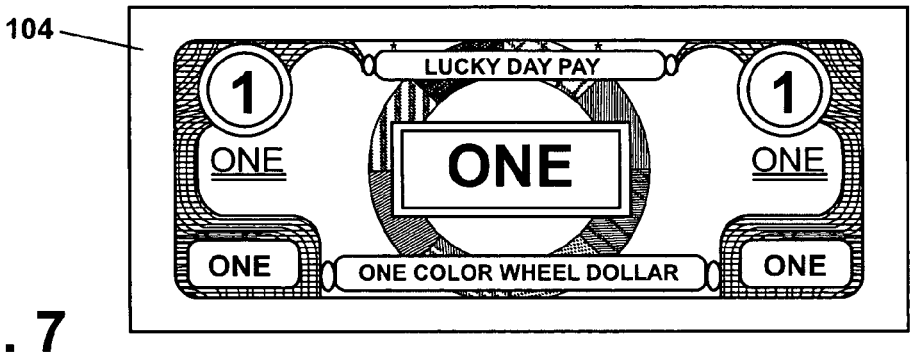
FIG. 7 is a plan view of an exemplary one dollar monetary card.

Referring now to FIGS. 6 and 7, a plurality of play money bills is provided for use with a speculator option of the present game. These bills include a plurality of five dollar bills 102 and a plurality of one dollar bills 104 which are distributed before the start of play to each of the individual players. The use of five dollar bills 102 and one dollar bills 104 will be described in greater detail in reference to the rules of play provided below.

Figure 8:
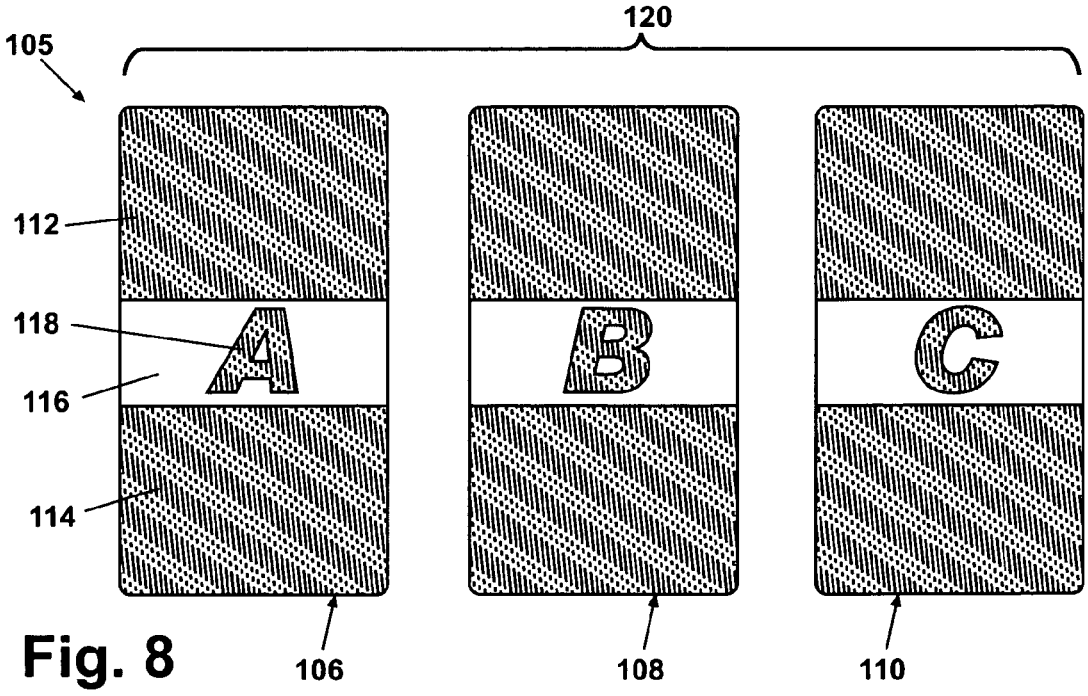
FIG. 8 is a plan view of an exemplary set of color cards.

Referring generally now to FIG. 8, a plurality of color cards 105 are provided, one for each of the alphabet letters displayed about game board 10. For example, a first, second and third color card 106, 108, 110 are shown. Each color card includes a first color area 112 and a second color area 114 separated by a white color area 116. One of the alphabet letters A through X is displayed on each of the color cards 105 in the white color area 116. In this example, the letter "A" 118 is provided with first color card 106. The color of both color areas 112 and 114 of each color card 105 match each other. The color of first, second and third color cards 106, 108, 110 in this example matches the color of first color bar 32. A color card group 120 is therefore formed having the consecutive alphabet letters displayed in each of the three color cards 105 which correspond to one of the plurality of color bars of game board 10. Individual color card groups are therefore provided for each of the color bars.

Figure 9:
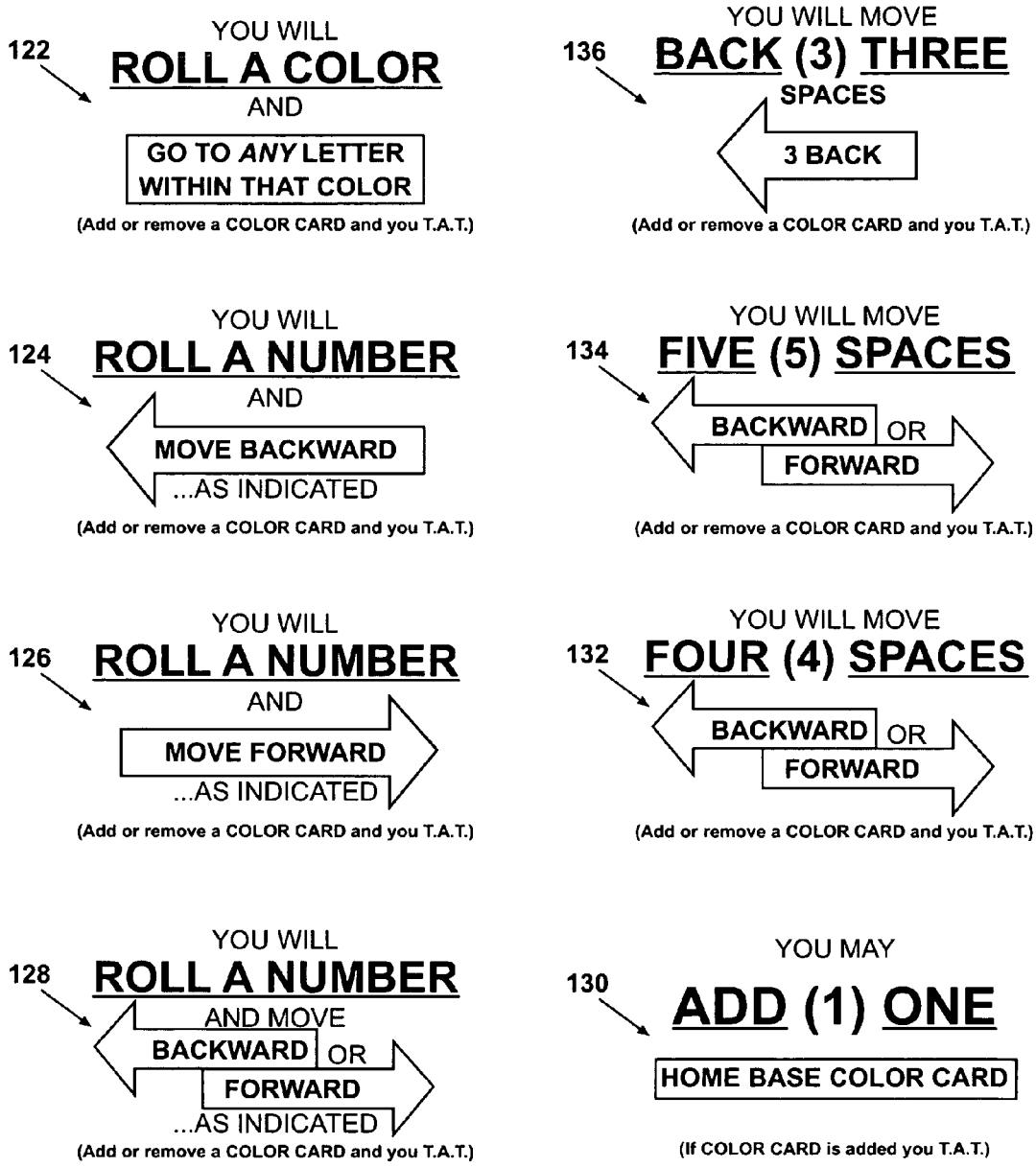
FIG. 9 is a plan view of a first portion of exemplary lucky day cards.

Referring now to FIGS. 9 through 11, a plurality of lucky day cards 122 through 166 are shown. A lucky day card is drawn when a player lands on one of the Luck Day Spaces 24, 54, 56, 58. Lucky day cards such as cards 122, 124, 126 and 128 direct the player to spin random indicator device 60 and follow the directions such as identifying the color identified by arrowhead 76 and going to any letter with that color, or identifying the number indicated by arrowhead 76 and moving an appropriate number of spaces indicated by the number. Lucky day cards 130 through 144 generally direct movement by a predetermined number of spaces or adding or removing home base color cards. Lucky day cards 146 and 148 are wild cards which can be saved by the player for use or sale any time thereafter. Lucky day cards 150 and 154 through 166 direct the player to go to a specific color on game board 10. Lucky day card 152 is used to direct an opponent to remove four home base color cards from game board 10.

Figure 12:
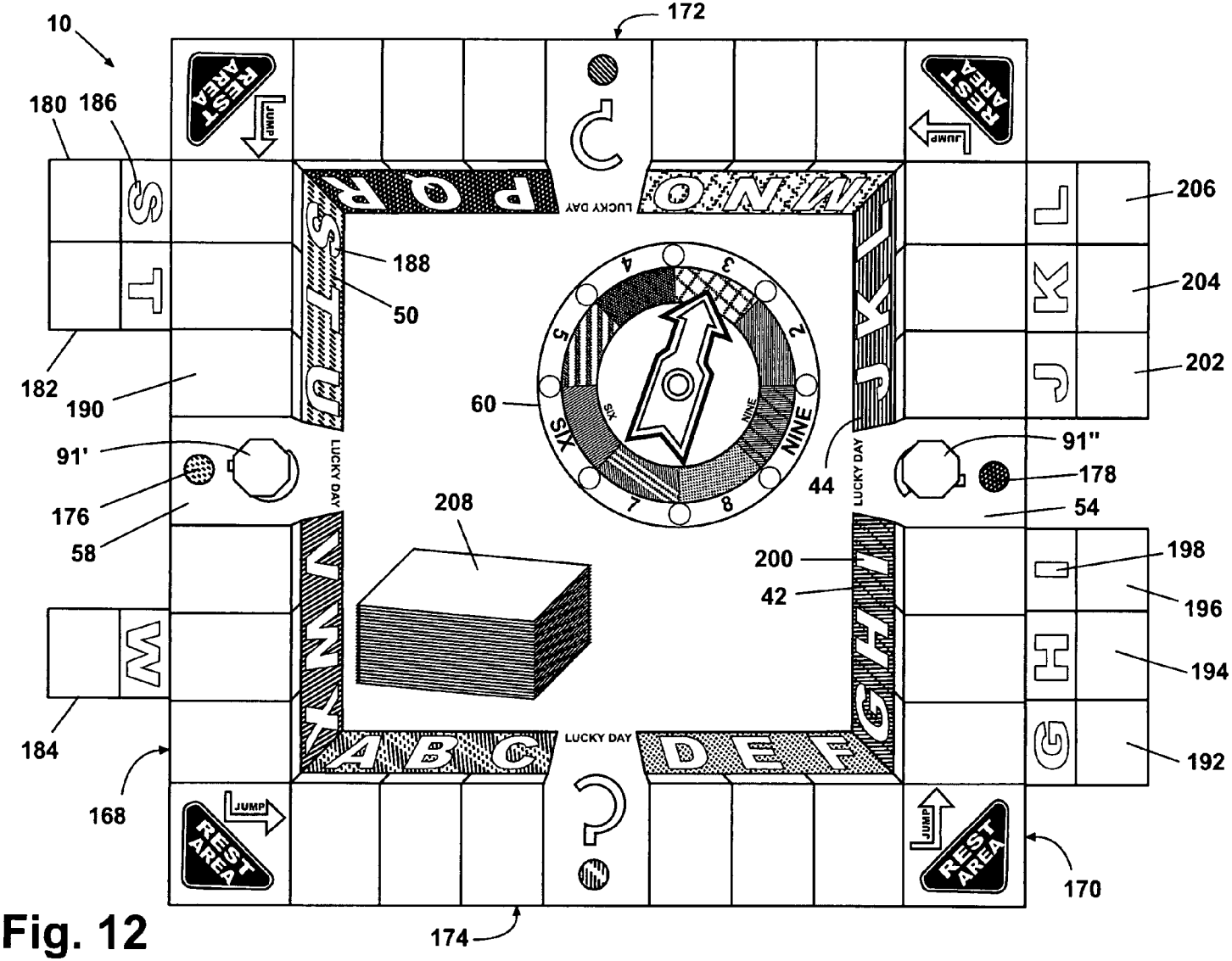
FIG. 12 is a plan view of the game board of FIG. 1 further showing an exemplary configuration of a game in progress.

Referring now generally to FIG. 12, an exemplary view of game board 10 during play by two players is shown. In this example, a first player has selected a first player side 168 and a second player has selected a second player side 170. This leaves an open side 172 and an open side 174 of game board 10. Each of the two players positions their respective game piece 91', 91" on fourth lucky day space 58 and second lucky day space 54 respectively. Each of the lucky day spaces includes a color designator having one of the colors of the color bars of that side of game board 10 displayed thereon. For example, fourth lucky day space 58 includes a color designator 176 having the exemplary color of seventh color bar 50. Second lucky day space 54 being used by the second player has a color designator 178 displaying the color of third color bar 42. Each of the players selects one of the game pieces 91 which matches the color of the specific color designator on their selected side of game board 10. For example, game piece 91' has the same color as both color designator 176 and seventh color bar 50, and game piece 91" has the same color displayed by both color designator 178 and third color bar 42. Each of the players therefore places their game piece 91', 91" on the specific lucky day space on their side of game board 10. In some versions of the game the game pieces 91 move counter-clockwise about game board 10 and in other versions game pieces 91 do not move from the specific lucky day spaces.

As further shown in FIG. 12, when selecting one of the sides or edges 11 of game board 10 for play, the player is therefore distributed each of the color cards matching the color bars and alphabet letters on that side of game board 10. When the color segment 66 indicated by random indicator device 60 matches one of the color bar colors of the spinning player, he/she places one of their color cards such that first color area 112 is partially under game board 10. White color area 116 of the color card completely showing the specific alphabet letter is displayed corresponding to the alphabet letter of the particular space. In this example, the first player has positioned color cards 180, 182 and 184 at each of the spaces matching the designated alphabet letters. For example, a letter "S" of color card 180 matches a letter "S" 188 of seventh color bar 50 when color card 180 is positioned proximate thereto. In this example, at least one non-carded space 190 is open meaning that a color card 105 has not yet been positioned proximate thereto or has been removed in response to an action directed by of one of the Lucky Day Cards 121.

As best seen to the right in FIG. 12, on the second player's side of the game board 10 the second player has positioned a color card proximate to each of the alphabet letters of both third and fourth color bars 42, 44. A color card 192, 194 and 196 is therefore positioned corresponding to each of an alphabet letter "G", "H", "I" of third color bar 42. For example, color card 196 includes a letter "I" which corresponds to an alphabet letter "I" (item 200) of third color bar 42. Similarly, each of a color card 202, 204 and 206 are positioned corresponding to alphabet letters designated in the fourth color bar 44. Once all of the color cards for a given player are positioned as shown to the right in FIG. 12, that player is considered to be a DECIMATOR or the equivalent ELIMINATOR which will affect play as described in the rules section to follow.

By designating each of the color cards with an individual one of the alphabet letters a younger player can learn to identify the individual alphabet letters by shape and name. The individual colors of each color card also help the younger player identify the areas on game board 10 associated with the various letters of the alphabet to help visually relate the sequence of one alphabet letter to another. A lucky day card stack 208 and random indicator device 60 are shown positioned on an inner open area of game board 10. These items can also be positioned anywhere the players desire. Lucky day card stack 208 includes each of the lucky day cards 122 through 166.

Game board 10 as described above is exemplary of multiple possible shapes for the board. Alternate shapes can also be used, not limited to triangle, rectangle, oval, circle, and polygonal shapes. The quantity of lucky day spaces, rest area spaces, playing pieces and lettered spaces can therefore be varied to suit the geometric shape of game board 10. For example, with a triangular-shaped game board 10, only three lucky day spaces and three rest area spaces are required and play would be limited to three players, with three playing pieces. Circular or oval shaped game boards can also be used with defined home bases being between two consecutive rest area spaces. Game board 10 and the remaining game items can also be electronically generated images for example, for use in an electronic version of the game, where the images are provided on a projection, video, LCD, or other electronic presentation format. The shape of the color cards can therefore also be varied to correspond to the board shape. The game is therefore not limited by the presentation format.

The game includes at least two levels of play, Regular Play and Speculator Play. Speculator Play involves use of additional parts which will be described below in greater detail, and extended rules.

Game Rules

Regular Play (2 Players)

For Regular Play, players do not use 'Speculator Play' parts or Speculator Play rules. Therefore, in Regular Play, players do not use LUCKY DAY cards 121; do not use play money 101; use only the colors of color segments 66 (not the numbers) on the random indicator device 60; use the 24 color cards 105, having alphabet letters "A" thru "X"; and pawns 91 stay on their LUCKY DAY space (24, 54, 56, 58) throughout the game and do not move about the game board 10. For Regular Play with 2 players, the youngest player starts play. The Home Base for each player is one of edges 11 of board 10 selected by that player. Each player's pawn 91 matches their first Home Base color and will stay on their LUCKY DAY space 23. Six (6) Home Base color cards 105 are kept at the ready by each player. Players will insert or remove color cards 105 under the edge 11 of the board 10 at matching letters as play dictates. Players adding or causing the removal of any color card 105 will take another turn. Player number one starts play by:

1) Spinning their own Home Base color: the spinner positions a color card 105 under the edge 11 proximate one of the Home Base letters of that color and takes another turn. A Triple carded Home Base is WILD;
2) Spinning an idle color, defined as any color which is not the Home Base of any player. The spinner places one idle color card 105 of that color at the edge 11, proximate the corresponding letter, and takes another turn. An idle color which is triple carded (having all three letters with the same color cards positioned proximate thereto) is also Wild;
3) Spinning a WILD color, (a triple carded Home Base color or triple carded idle color). The spinner places one of the spinner's color cards 105 at any needed Home Base letter and takes another turn; or
4) Spinning an opponents' color. When this occurs the spinning player must stop and the turn ends.

The APPARENT WINNER is the first player to position their color cards 105 at all six (6) of that player's Home Base letters. The game stops unless an APPARENT LOSER requests a 'LAST CHANCE'. When a LAST CHANCE is requested, the APPARENT LOSER begins a continued play hoping to become a DECIMATOR before being decimated by the APPARENT WINNER. Continued play always begins with the APPARENT LOSER.

During LAST CHANCE, the rules are the same as before last chance was requested with the added DECIMATOR status for any player with all six (6) HOME BASE letters color carded. Thus, the APPARENT LOSER beginning their last chance hopes to get all six (6) Home Base letters color carded and now as a DECIMATOR continuing on to remove color cards from the APPARENT WINNER.

1) Any player in DECIMATOR mode spinning his/her Home Base or a WILD color can demand the opponent remove two (2) of their Home Base color cards 105. The Decimator will then take another turn; and
2) A player spinning an opponent's color will stop. The turn ends the same as before LAST CHANCE.

Players who are decimated, which is defined as any player who does not have any color cards 105 to remove must finally remove their own pawn 91, (pawn value=one (1) color card). The game ends with one (1) REAL WINNER and one (1) totally bankrupted REAL LOSER defined as a player having no Home Base color cards 105 and no pawn 91.

Regular Play (3 Players)

The first player to Color Card all six (6) Home Base letters is the APPARENT WINNER. The youngest player starts, similar to a 2 player game. A three player game proceeds with one (1) side of the game board 10 idle. Rules for a three player game are the same as the two player game identified above. Up to two APPARENT LOSERS can result. If a LAST CHANCE is requested by either of the two APPARENT LOSERS, the next player in turn spins hoping to become a DECIMATOR before being decimated by the APPARENT WINNER.

During LAST CHANCE:

1) Any player in DECIMATOR or ELIMINATOR mode, (color cards 105 on all six (6) Home Base letters), spinning a Home Base color or an IDLE WILD color (an idle color triple carded) will direct each opponent to remove two (2) color cards apiece. The DECIMATOR/ELIMINATOR then takes another turn. A player being decimated/eliminated without having any color cards 105 must finally remove their pawn 91 (one (1) color card value) becoming the first DEACTIVATED PLAYER;
2) The first DEACTIVATED PLAYER is the first to lose all six (6) Home Base color cards 105 and their pawn 91. This player can be reactivated provided the other opponent is still alive with their pawn 91 on the game board 10. To reactivate: the DEACTIVATED PLAYER, on his/her turn, spins the random indicator device 60 hoping to spin one of his/her Home Base colors or any idle color (idle color need not be WILD). Doing so, this player is reactivated. The REACTIVATED PLAYER places their pawn back on their LUCKY DAY space 24, 54, 56 or 58 and takes another turn. If the color of either opponent is spun, a DEACTIVATED PLAYER stops, and their turn ends. Now they are an Active Player with a pawn and no color cards; and
3) If a DEACTIVATED PLAYER, on his/her turn, chooses not to try for reactivation, that player is the FIRST REAL LOSER. The REAL LOSER's side of the board then becomes idle, as in a two (2) player game, ready to become WILD by color carding.

The game ends when both opponents are DEACTIVATED having no color cards 105 to remove and both pawns 91 finally removed. The game therefore ends with one (1) REAL WINNER and two (2) totally bankrupted REAL LOSERs having no color cards 105 and no pawns 91.

Regular Play (4 Player Partners)

Each player chooses any of the four sides of the board as their own. The four players divide into two teams each having two player/partners having four (4) colors between them. Each team challenges the other team and their four (4) colors. Individual players will install pawns 91 at their individual Home Base.

The youngest player starts. During each player's turn, the player can:

1) Spin a partner's color: The team Color Cards a letter there and the player takes another turn. If the color spun is WILD, (triple carded), the spinning team Color Cards any letter the team needs and takes another turn.
2) Spin a Home Base color: The team Color Cards a letter there and takes another turn. If the color is WILD, (triple carded), the spinning team Color Cards any letter the team needs and takes another turn.
3) Spin any of the opposing teams' 4 colors: This spinner must stop and the turn ends.

An APPARENT WINNING TEAM will be the first team to have color cards 105 on all twelve (12) of that team's Home Base letters x. If a LAST CHANCE is requested by the APPARENT LOSING TEAM, the next player on the APPARENT LOSING TEAM begins continued play hoping the team becomes a DECIMATING TEAM before being Decimated. Partners are a DECIMATING TEAM whenever the players of that team have color cards 105 on all 12 of their Home Base letters.

During LAST CHANCE:

1) The DECIMATING TEAM players, at their individual turn, hope to spin any of the team's four (4) Home Base colors. If this occurs, the opponent team members each remove two (2) color cards 105 apiece (total four (4) removed). The DECIMATING TEAM player then takes another turn.
2) An opponent team member being decimated (without color cards 105 to remove) must finally remove his/her pawn 91 (one (1) color card value) and therefore becomes DEACTIVATED.
3) A DEACTIVATED player (a player having no pawn 91) will continue to spin at their turn so long as the deactivated player's partner is still 'alive' (partners pawn is still in play).

REACTIVATION can occur if a pawnless player spins any of their team's four (4) Home Base colors. The missing pawn 91 is then placed back in play (pawn placed back on LUCKY DAY spot). The REACTIVATED player will then take another turn. REACTIVATION also occurs when a DEACTIVATED PLAYER's partner (who still has a pawn in play) during their turn spins any of their team's four (4) Home Base colors. The REACTIVATED player's partner will accordingly take another turn. A team member having their partner deactivated, who is subsequently decimated (without Color Cards to remove) must finally remove his/her own pawn 91 ending all play. The GAME ENDS with TWO (2) REAL WINNERS and TWO (2) LOSERS (having no Color Cards and no pawns).

Speculator Play

In Speculator Play, players: use PLAY MONEY 101 (Cash equivalents: color card=$2 value, pawn=$1 value); use LUCKY DAY cards 121; use the numbers and colors on the random indicator device 60; and pawns 91 start at each players' respective HOME BASE LUCKY DAY space 24, 54, 56 or 58. The color of each pawn 91 matches a player's first HOME BASE color. Pawns 91 also move about game board 10 in a counterclockwise direction.

Speculator Play (2 Players)

The player having the highest number spun starts play. HOME BASE for each player is the one (1) side of the board of their choice. $20 in play money 101 (three $5 bills and five $1 bills) are each player's gamble. SIX (6) HOME BASE color cards 105 are kept at the ready by each player. Players will insert or remove color cards 105 under the corresponding edge 11 of game board 10, at a corresponding letter, as play dictates. The player's pawn 91 is placed on the LUCKY DAY space 23 corresponding to each player's HOME BASE side or edge 11 to start. Two edges of game board 10 (in the 2 player game) that are not the HOME BASE of either player are IDLE, and therefore ready to become WILD by Color Carding.

PLAYER number 1 starts by spinning a number and moving their pawn 91 the number of spaces indicated (counterclockwise). This can result in several outcomes:

1) Landing on your own HOME BASE letter (space), not yet Color Carded. The spinning player Color Cards that letter and takes another turn.
2) Landing on an IDLE color letter (letters not belonging to either players' HOME BASE) which are not color carded. The spinning player Color Cards that letter and takes another turn.
3) Landing on an IDLE color letter, carded but not yet wild (not yet triple carded), or landing on a HOME BASE letter color carded but not yet WILD. The spinning player must stop and the turn ends.
4) Landing on a WILD color letter (triple carded IDLE color letter, or triple carded HOME BASE color letter). The spinning player Color Cards any needed HOME BASE letter and takes another turn.
5) Landing on a REST AREA space 16. The spinning player must stop and the turn ends, or the spinning player can JUMP to the next REST AREA space 16 where the spinning player stops and the turn ends.
6) Landing on any LUCKY DAY space 23. The spinning player flips the top LUCKY DAY card 121 on the LUCKY DAY card stack 208 and follows the instructions given on the card. "Y" and "Z" lettered LUCKY DAY cards are WILD CARDS and are kept until the player chooses to use them, or sells them to an opponent for any agreed upon price.
7) Landing on opponent's HOME BASE letter. The spinning player is trespassing and must pay the penalty identified below, and then the turn ends.
8) Should a player not have enough cash to pay the money owed for any reason, then that player must remove one or more HOME BASE color card(s) 105, ($2 per color card) to make up the difference.

Penalties for trespassing are the same for all levels (2, 3 or 4 player games) of Speculator Play. A letter with no color card=$0 (NO PENALTY). A letter carded with a single or double color=$1 PENALTY. A letter carded with a triple color=$2 PENALTY. A letter carded with a double/triple color (defined as color cards 105 on all six (6) of an opponent's HOME BASE letters)=$4 PENALTY. If a player is short the amount of cash needed to pay the money owed, the player will remove any HOME BASE color cards(s) 105 of their choosing to make up the difference. In this case, since color cards were removed, that player will take another turn.

The APPARENT WINNER will have color cards 105 on all six (6) HOME BASE letters. Should the APPARENT LOSER not take their LAST CHANCE, then the loser will pay the winner two ($2) dollars per letter not carded in the Loser's HOME BASE and the game ends. (Each color card=$2 cash equivalent).

If the APPARENT LOSER requests a LAST CHANCE: the APPARENT LOSER begins continued play hoping to become a DECIMATOR (color cards 105 on all six HOME BASE letters), before being decimated by the APPARENT WINNER. An APPARENT WINNER never begins continued play.

During LAST CHANCE: All rules are the same as before the LAST CHANCE was requested, with the added DECIMATOR status during the time a player has color cards 105 on all six HOME BASE letters.

1) The APPARENT LOSER, beginning continued play, spins the color wheel, hoping to keep on Color Carding and taking another turn until attaining DECIMATOR status with color cards 105 on all six of their HOME BASE Letters. Continuing the play, the APPARENT LOSER turned DECIMATOR will remove DECIMATER status from the APPARENT WINNER by deleting the opponents' color cards 105 and accordingly takes another turn after each removed color card 105.
2) Players in DECIMATOR mode spin hoping to land on their own HOME BASE letter, (which is WILD) or a WILD IDLE color letter. When doing so, the opponent must remove two (2) Color cards 105 and the DECIMATOR takes another turn.

3) If the player being decimated has run out of color cards 105 to remove, that player must pay the difference with the cash equivalent to the DECIMATOR ($2 per color card not removed). If no color card 105 is removed (only cash ($4) paid), then the DECIMATOR does not take another turn.
4) Players being decimated with no cash and no color cards 105 to remove must finally remove their own pawn 91 (speculator play pawn value one ($1) dollar).

The game ends with 1 REAL WINNER and 1 totally BANKRUPTED REAL LOSER having no home base color cards 105, no pawn 91, and no play money 101.

Speculator Play (3 Players)

For this level of play, as in all levels, the cash equivalents are the same: color card=$2 value, pawn=$1 value) $20 play money 101 (three $5 bills and five $1 bills) are each players gamble. Only one (1) edge 11 of game board 10 is IDLE (ready to become WILD). DECIMATORs will require each opponent to remove two 2) color cards 105 apiece (total four (4)) when a DECIMATOR lands on their own HOME BASE or WILD IDLE color letter. Any instructions given by LUCKY DAY cards 121 for any opponent applies to both opponents equally. Penalties for landing on an opponent's HOME BASE letter (space) are paid individually by the one trespassing player to the one offended opponent (same as in 2 player). The APPARENT WINNER will have color cards 105 on all six (6) HOME BASE letters. The APPARENT LOSER(s) will pay the APPARENT WINNER(s) $2 per uncarded HOME BASE letter (space) if a LAST CHANCE is not requested. If a LAST CHANCE is requested: the next player, in turn, begins continued play hoping to become a DECIMATOR by taking another turn over and over until all opponents are eliminated.

DURING LAST CHANCE:

1) DECIMATORS spin hoping to land on their HOME BASE letter or a WILD IDLE letter. Doing so, each opponent must remove two (2) color cards 105 apiece. The DECIMATOR then takes another turn.
2) Opponents who are short color cards 105 to remove from the board 10 must pay the DECIMATOR $2 cash per color card 105 not removed. If no color cards 105 are removed, (only cash is paid) the DECIMATOR does not take another turn.
3) Players without cash who owe money for any reason, must remove a color card equivalent. In SPECULATOR PLAY two ($2) dollars cash always equals one (1) color card 105.
4) A player owing money but short cash and without color cards 105 must remove their last play piece, the pawn 91 (pawn=$1 value). This player is then APPARENTLY BANKRUPT and DEACTIVATED.
5) An APPARENTLY BANKRUPT player (no HOME BASE color cards 105, no play money 101, no pawn 91) is still alive so long as: Another opponent is still alive (pawn 91 not removed) and the APPARENTLY BANKRUPT player, on their turn, chooses to spin the random indicator device 60 hoping to spin any HOME BASE color or any IDLE color, thereby putting that player's pawn 91 back on their LUCKY DAY space 24, 54, 56 or 58 and then takes another turn. Spinning any opponent's color, an apparently bankrupt player's play ends, and they pay no penalties.
6) An APPARENTLY BANKRUPT player becomes the first REAL LOSER by choosing not to spin the random indicator device 60 at their turn. The game will then continue as a two (2) player game with the first REAL LOSER's side of board IDLE, ready to become WILD by Color Carding.
7) A DECIMATOR removing both opponents' HOME BASE color cards 105, and claiming all play money 101 on the game board 10 (sixty dollars $60 total), and finally removing both opponents' pawns 91, ends all play. The game ends with 1 REAL WINNER and 2 totally BANKRUPTED REAL LOSERS (having no color cards 105, no pawns 91 and no play money 101).

Speculator Play (4 Players—Limited Partners)

This version is similar to the 2 and 3 player versions. Partners pick any two (2) edges 11 of the game board 10 (2 against 2). Each individual player starts with $20 as before ($80 total involved). Penalties are the same ($0, $1, $2 and $4), as in Speculator Play for 2 and 3 players. Players landing on their own HOME BASE letter or a partner's HOME BASE letter will Color Card it and take another turn. Players landing on a HOME BASE WILD letter or a partner's HOME BASE WILD letter will Color Card any of the (twelve (12)) TEAM letters not yet carded, and take another turn. Each player pays penalties individually for trespassing on an offended opponent's HOME BASE. Therefore, winning team members will end the game with differing amounts of cash. The APPARENT WINNING TEAM will have all twelve (12) HOME BASE letters color carded. The APPARENT LOSING TEAM members will pay $2 per uncarded HOME BASE letter, divided equally to the winning team members.

If a LAST CHANCE is requested, the next APPARENT LOSING TEAM player begins continued play hoping to have their team become a DECIMATING TEAM before themselves being decimated. During LAST CHANCE play:

1) The DECIMATORs hope to land on any of their twelve (12) HOME BASE letters. If this occurs, the opponent team members will remove two (2) color cards 105 apiece, and the spinning DECIMATOR will then take another turn. Players exhausting their color cards 105 to remove must pay a cash equivalent to make up the difference ($2 per color card 105). If at least one (1) color card 105 is removed, the Decimator takes another turn.
2) Players who are out of play money 101 and owe money, and who do not have color cards 105 to remove, must remove their pawn 91 (the last play piece to be removed and worth one ($1) value).
3) A DEACTIVATED TEAM MEMBER, who is APPARENTLY BANKRUPT (no play money 101, no color cards 105, and no pawn 91) can be REACTIVATED, so long as their partner's pawn 91 is still on the game board 10. At their turn, the DEACTIVATED TEAM MEMBER spins the random indicator device 60, hoping to land on any of their team's four (4) HOME BASE colors. If doing so, the player places his/her pawn 91 back on their LUCKY DAY space 24, 54, 56 or 58 and then takes another turn. Upon spinning any of the opponents' four (4) HOME BASE colors, the DEACTIVATED TEAM MEMBER will stop. No penalty payment is owed, but this player must wait until the next turn. If no pawn was installed, this player is still deactivated. If a pawn was installed and lost, this player is again deactivated.
4) A HEALTHY TEAM MEMBER (a player whose pawn 91 is still on game board 10), with a DEACTIVATED partner, will, at their turn, also spin random indicator device 60, hoping to spin a HOME BASE color or their partner's HOME BASE color. This reactivates the DEACTIVATED partner's pawn 91. The HEALTHY TEAM MEMBER then takes another turn.

5) A DECIMATOR TEAM removing all twelve (12) of the opposing team's color cards 105, and claiming all play money 101 on the game board 10, and finally deleting both of the opposing team's pawns 91, ends all play. The game ends with 2 REAL WINNERS, both having differing amounts of cash, and two (2) finally and totally bankrupted REAL LOSERS (having no color cards 105, no pawns 91, and no play money 101).

A board game of the present disclosure offers several advantages. The game board includes individual spaces each having an alphabet letter displayed thereon. A color card is provided for each colored space also having an alphabet letter. Matching the color cards to the appropriate spaces therefore teaches players to recognize the individual alphabet letters. The use of play money and lucky day instruction cards also introduces more sophisticated levels of play for between two and four players. The introduction of a decimator status also introduces a heightened element of competition. Further options such as selection of a last chance provide a player previously eliminated the opportunity to be reinstated to the game. Thus, all players can be actively involved and participating in game play until all play ends, unlike other board games where eliminated players must wait outside of the action until the winner is decided.

It is alternately envisioned that the presentation could be incorporated into a video or computer game and therefore electronically presented. It is further envisioned that the board, cards and spinner (or random selection device) may have differing shapes from those identified herein. The description of the present disclosure is merely exemplary in nature and, thus, variations that do not depart from the gist of the disclosure are intended to be within the scope of the disclosure. Such variations are not to be regarded as a departure from the spirit and scope of the disclosure.

What is claimed is:

1. A board game, comprising:

a game board having a continuous path around a board perimeter having at least three sides divided into consecutive spaces, including:

a first group of the spaces each displaying a different letter of the alphabet, the alphabet letters defining consecutive letters ranging from A through X arranged sequentially on consecutive ones of the sides, the first group being further divisible into a plurality of subgroups each having three of the letters such that each side has at least two of the subgroups, each subgroup having a subgroup color different from any other subgroup, each of the subgroups further includes three abutting spaces having consecutive ones of the consecutive letters;

a second group of the spaces each having a designation of rest area positioned in each of a plurality of corner spaces about the game board; and a third group of the spaces each defining a lucky day space, each one of the lucky day spaces positioned between consecutive ones of the rest area spaces; and multiple color cards, each displaying one of the alphabet letters and each being of a size to be movably positioned proximate a corresponding one of the first group of spaces having a same one of the alphabet letters.

2. The board game of claim 1, further comprising a random selection device having a plurality of color sections individually colored with a unique one of the subgroup colors and operable to randomly indicate placement of one of the plurality of color cards about the perimeter of the game board.

3. The board game of claim 2, wherein the random selection device further comprises:

a rotatable element having the color sections disposed thereon;

a base element non-rotatable with respect to the rotatable element; and an indicator element non-rotatable with respect to the rotatable element;

wherein one of the plurality of color sections is alignable with the indicator element following rotation of the rotatable element.

4. The board game of claim 3, further comprising:

a plurality of sequential numbers, individual ones of the numbers displayable on the rotatable element proximate one of the subgroup colors;

wherein the plurality of sequential numbers ranges from 2 to 9.

5. The board game of claim 1, wherein any one of the lucky day spaces is distinguishable from any other one of the lucky day spaces by a portion colored with a selected one of the subgroup colors.

6. The board game of claim 1, further comprising multiple game pieces individually color matched with one of the subgroup colors and movably positionable on any one of the spaces.

7. The board game of claim 6, further comprising a plurality of lucky day cards operable to direct a player action, one of the cards being selected when one of the game pieces lands on one of the lucky day spaces.

8. The board game of claim 1, further comprising at least one denomination of play money bills given to each player at the start of a game.

9. The board game of claim 1, further comprising:

a first level of play; and at least a second level of play including additional play rules and procedures different from the first level of play.

10. A method for playing a board game, the game including a game board having a continuous path around a perimeter divided into consecutive spaces, a first group of the spaces each displaying one letter of the alphabet, the first group being further divisible into a plurality of subgroups, each subgroup having a subgroup color different from any other subgroup, and multiple color cards, each displaying one of the alphabet letters and each being of a size to be movably positioned proximate a corresponding one of the first group of spaces having a same one of the alphabet letters, the method comprising:

selecting a portion of the perimeter as a home base side of the game board having two of the subgroups for each of a plurality of players;

distributing selected ones of the color cards to each of the players, the selected ones of the color cards for each player each having a color matching one of the subgroup colors of the two subgroups for the side of each player;

each player of the plurality of players in turn as a random indication device operating player operating a random indication device operable to identify one of the subgroup colors;

when indicated by the random indication device the random indication device operating player positions one of the color cards on the home base side corresponding to one of the alphabet letters; and stopping a turn of the random indication device operating player when the random indication device identifies one of the subgroup colors of any of the other ones of the plurality of players;

temporarily deactivating a first one of the players when the selected ones of the color cards of the first player are removed from the game board; and reactivating the first player when the first player operates the random indication device and a subgroup color of an opponent is indicated.

11. The method of claim 10, further comprising:

distributing an individual game piece to each player prior to the operating step;

moving the game piece in response to a number indicated on the random indication device during the operating step.

12. The method of claim 11, further comprising:

moving one of the game pieces to one of a plurality of lucky day spaces positioned about the perimeter in response to the number indicated on the spinner device;

selecting one of a plurality of lucky day cards; and following the directions given on the one lucky day card selected.

13. The method of claim 12, further comprising stopping the turn of the random indication device operating player when the game piece of the random indication device operating player lands on one of a plurality of rest area spaces positioned about the perimeter.

14. The method of claim 11, further comprising:

dividing a group of four players into two teams having two players each; and continuing game play until both players of a first one of the two teams have relinquished all of the color cards corresponding to the first team and each of the game pieces corresponding to the first team.

15. The method of claim 10, further comprising ending a game when each of the spaces of one of the home base sides contains a corresponding one of the color cards.

16. The method of claim 10, further comprising:

spinning the random indication device when that one subgroup color is triple color carded by a player operably redefines one of the subgroup colors of an idle side of the game board unused by any player as a wild space.

17. The method of claim 16, further comprising grouping four players into two teams of two players each.

18. The method of claim 16, further comprising:

creating the random indication device having:

a portion with a color segment;

a non-rotatable portion; and an indicator device which is non-rotatable with respect to the portion with the color segment; and initiating motion of the portion with the color segment.

19. A method for playing a board game, the game including a game board having a continuous path around a perimeter divided into consecutive spaces, a first group of the spaces each displaying one letter of the alphabet the first group being further divisible into a plurality of subgroups, each subgroup having a subgroup color different from any other subgroup, and multiple color cards, each displaying one of the alphabet letters and each being of a size to be movably positioned proximate a corresponding one of the first group of spaces having a same one of the alphabet letters, the method comprising:

each player of a plurality of players selecting one of a plurality of sides of the game board defining a home base side of the game board for each player, with a each home base side having two of the subgroups;

distributing selected ones of the color cards to each of the players, the selected ones of the color cards for each player each having a color matching one of the subgroup colors of the two subgroups for the side of each player;

each of the players in turn operating a random indication device to identify one of the subgroup colors;

when the random indication device indicates a color of the player operating the device the player operating the device positions one of the color cards on a home base space corresponding to one of the alphabet letters;

stopping a turn of the player operating the device when the random indication device identifies one of the subgroup colors of any of the players not operating the device;

designating a first one of the players as an eliminator when each of the spaces of the home base sides of the first one of the players contains a corresponding one of the color cards; and the eliminator directs removal of individual ones of the color cards of one of the players not operating the device based on operation of the random indication device.

20. A method for playing a board game, the board game including a game board having a continuous path around a perimeter divided into consecutive spaces, a first group of the spaces each displaying one letter of the alphabet consecutively ranging from A through X, the first group being further divisible into a plurality of subgroups, each subgroup having a subgroup color different from any other subgroup, and multiple color cards, each displaying one of the alphabet letters and each being of a size to be releasably positioned proximate a corresponding one of the first group of spaces having a same one of the alphabet letters, the method comprising:

each player of a plurality of players selecting one of a plurality of sides of the game board defining a home base side having two of the subgroups;

distributing selected ones of the color cards to each of the players, the selected ones of the color cards for each player having colors matching the subgroup color of both of the two subgroups for the home base side of each player;

distributing a plurality of play money bills to each of the players;

each of the players in turn operating a random indication device to identify one of the subgroup colors;

when the random indication device indicates a color of the player operating the device the player operating the device positions one of the color cards on a home base space corresponding to one of the alphabet letters;

when the random indication device indicates a first color of a first one of the players not operating the device whose home base side includes the first color, the player operating the device pays a portion of the play money bills to the first one of the players; and stopping a turn of the player operating the device when the random indication device identifies one of the subgroup colors of any of the players not operating the device.

21. The method of claim 20, further comprising:

distributing an individual game piece to each player; and moving one of the game pieces in response to a number indicated by the random indication device.

22. The method of claim 21, further comprising:

positioning a second group of the spaces each designated a rest area about the perimeter which require the player operating the device to stop the turn when the game piece reaches one of the rest area spaces; and positioning a third group of the spaces each designated a lucky day space between consecutive ones of the rest area spaces which require the player operating the device to take a card when the game piece reaches one of the lucky day spaces.

23. The method of claim 22, further comprising:

moving one of the game pieces to one of the lucky day spaces in response to the number indicated on the random indication device;

selecting one of a plurality of lucky day cards; and following the directions given on the one lucky day card selected.

24. A method for playing a board game, the board game including a game board having a continuous path around a perimeter divided into consecutive spaces, a first group of the spaces each displaying one letter of the alphabet consecutively ranging from A through X, the first group being further divisible into a plurality of subgroups, each subgroup having a subgroup color different from any other subgroup, and multiple color cards, each displaying one of the alphabet letters and each being of a size to be releasably positioned proximate a corresponding one of the first group of spaces having a same one of the alphabet letters, the method comprising:

each player of a plurality of players selecting one of a plurality of sides of the game board defining a home base side having two of the subgroups;

distributing selected ones of the color cards to each of the players, the selected ones of the color cards for each player having colors matching the subgroup color of at least one of the two subgroups for the home base side of each player;

distributing a plurality of play money bills to each of the players;

distributing a unique game piece to each player;

each of the players in turn operating a random indication device to identify one of a group of random numbers ranging from 1 to 9, the one number directing a quantity of spaces to move the unique game piece of the player operating the random indication device;

when the playing piece is directed to a space having a color of the player operating the device the player operating the device positions one of the color cards on a home base space corresponding to one of the alphabet letters;

when the playing piece of the player operating the random indication device is directed to a space having a first color of a first one of the players not operating the device whose home base side includes the first color, the player operating the device pays a portion of the play money bills to the first one of the players; and stopping a turn of the player operating the device when the playing piece of the player operating the random indication device is directed to one of the spaces of any of the players not operating the device.

25. The method of claim 24, further comprising:

positioning a second group of the spaces each designated a rest area about the perimeter which require the player operating the device to stop the turn when the game piece reaches one of the rest area spaces; and positioning a third group of the spaces each designated a lucky day space between consecutive ones of the rest area spaces which require the player operating the device to take a card when the game piece reaches one of the lucky day spaces.

26. The method of claim 25, further comprising:

moving one of the game pieces to one of the lucky day spaces in response to the number indicated on the random indication device;

selecting one of a plurality of lucky day cards; and following the directions given on the one lucky day card selected.

27. The method of claim 24, further comprising:

creating the random indication device having:

a portion with a color segment;

a non-rotatable portion; and an indicator device which is non-rotatable with respect to the portion with the color segment; and initiating motion of the portion with the color segment.

* * * * *